US012674316B2

(12) United States Patent
Bielenberg

(10) Patent No.: US 12,674,316 B2
(45) Date of Patent: Jul. 7, 2026

(54) CONSTRUCTION SYSTEM

(71) Applicant: Original Engineering, LLC, Reno, NV (US)

(72) Inventor: Maximilian Bielenberg, Reno, NV (US)

(73) Assignee: Original Engineering, LLC, Reno, NV (US)

( * ) Notice: Subject to any disclaimer, the term of this patent is extended or adjusted under 35 U.S.C. 154(b) by 187 days.

(21) Appl. No.: 18/401,158

(22) Filed: Dec. 29, 2023

(65) Prior Publication Data

US 2024/0218655 A1 Jul. 4, 2024

Related U.S. Application Data

(60) Provisional application No. 63/475,922, filed on Dec. 29, 2022.

(51) Int. Cl.
*E04B 1/38* (2006.01)
*E04B 1/58* (2006.01)

(52) U.S. Cl.
CPC .... *E04B 1/5831* (2013.01); *E04B 2001/5862* (2013.01); *E04B 2001/5887* (2013.01)

(58) Field of Classification Search
CPC ..... E04B 1/5831; E04B 2001/5887; E04B 1/1903; F16B 7/048
See application file for complete search history.

(56) References Cited

U.S. PATENT DOCUMENTS

| | | | | |
|---|---|---|---|---|
| 1,092,217 | A | 4/1914 | Hopkins | |
| 1,347,808 | A | 7/1920 | Franklin | |
| 1,995,668 | A * | 3/1935 | Clark | F16B 7/048 52/651.1 |
| 3,148,539 | A | 9/1964 | Cook | |
| 3,176,428 | A | 4/1965 | Slingluff | |
| 3,221,464 | A | 12/1965 | Miller | |
| 3,422,565 | A | 1/1969 | Kentfield et al. | |
| 3,458,949 | A | 8/1969 | Young | |
| 3,469,339 | A | 9/1969 | Thomas | |
| 3,648,404 | A | 3/1972 | Ogsbury et al. | |
| D228,231 | S | 8/1973 | Titchy | |
| 3,752,472 | A | 8/1973 | Snead | |
| 3,830,011 | A | 8/1974 | Ochrymovich | |
| 4,030,209 | A | 6/1977 | Dreiding | |
| 4,274,222 | A | 6/1981 | Zahn et al. | |
| 4,288,937 | A * | 9/1981 | Virsen | F16B 7/048 40/607.1 |

(Continued)

FOREIGN PATENT DOCUMENTS

| | | |
|---|---|---|
| EP | 1690577 A3 | 7/2007 |
| KR | 101336672 | 12/2013 |

(Continued)

*Primary Examiner* — Basil S Katcheves
(74) *Attorney, Agent, or Firm* — Run8 Patent Group, LLC; Peter Miller; Leah Raddatz

(57) ABSTRACT

A construction system has rods and connectors that may be assembled and disassembled in order to be re-used to construct a variety of geometric figures and other figures. Each connector has a plurality of sockets configured to form joints with the rods. Each socket has a cavity where the cavity has aligned openings. The socket at one of the openings forms an interference fit with an inserted rod.

20 Claims, 10 Drawing Sheets

(56) References Cited

U.S. PATENT DOCUMENTS 4,313,687 A * 2/1982 Martinez Apeztegui ..... F16B 7/18 403/171
4,334,868 A 6/1982 Levinrad
4,384,801 A * 5/1983 Hamel ..... E04B 1/3211 52/81.3
4,449,843 A * 5/1984 Wendel ..... E04B 1/1903 52/81.3
4,484,429 A * 11/1984 Stephenson ..... G09B 25/04 403/171
4,498,800 A * 2/1985 Sielaff ..... E04B 1/3205 52/81.3
4,509,879 A * 4/1985 Pearce ..... E04B 1/1903 52/81.3
4,509,929 A 4/1985 Zawitz
4,511,278 A * 4/1985 Robinson ..... E04B 1/3211 52/81.3
4,515,497 A * 5/1985 Gillemot ..... F16B 7/048 D8/382
4,521,998 A * 6/1985 DeLorme ..... E04B 1/1903 52/81.3
4,701,131 A * 10/1987 Hildebrandt ..... G09B 23/26 434/211
4,712,184 A 12/1987 Haugerud
4,778,184 A 10/1988 Fleischer
4,781,644 A 11/1988 Yoshida
5,097,645 A 3/1992 Sanderson
D334,953 S 4/1993 Kawahara et al.
5,199,919 A 4/1993 Glickman
D341,169 S 11/1993 Denton
5,590,974 A * 1/1997 Yang ..... A47B 47/005 403/171
5,769,681 A 6/1998 Greenwood, Sr. et al.
5,788,555 A 8/1998 Glynn
5,853,313 A 12/1998 Zheng
6,478,649 B1 11/2002 Hoback
6,843,700 B2 1/2005 Glickman
7,267,598 B2 9/2007 Glickman
7,316,598 B1 1/2008 Lock
7,374,468 B2 5/2008 Flodin et al.
D686,675 S 7/2013 Jenson
D702,297 S 4/2014 Youngblood et al.
10,036,156 B1 * 7/2018 Macdonald ..... E04F 13/083
10,316,508 B1 * 6/2019 Hendry ..... E04B 1/5831
D892,945 S 8/2020 Patterson
2002/0110411 A1 8/2002 Chen
2002/0187720 A1 12/2002 Engle
2004/0158999 A1 8/2004 Trantow
2004/0253902 A1 12/2004 Sinisi
2009/0203288 A1 8/2009 Aggar et al.
2012/0184174 A1 7/2012 Kwak et al.
2016/0264187 A1 * 9/2016 Gami ..... B62D 27/02
2017/0020282 A1 * 1/2017 Bensen ..... F16B 5/0084
2025/0188736 A1 * 6/2025 Rudge ..... E04B 1/5831

FOREIGN PATENT DOCUMENTS

KR 101773024 5/2017
WO WO2014084510 8/2014

* cited by examiner

CONSTRUCTION SYSTEM

CROSS-REFERENCES

This application claims priority of U.S. provisional application Ser. No. 63/475,922 filed Dec. 29, 2022 and titled "System of Deformable Connectors and Rigid Rods and Method for Constructing Meshed Geometric Structures" by the present inventor.

BACKGROUND

Numerous construction kits and systems exist in the conventional art, each aimed at enabling the creation of various structures, both large and small. Many available sets, however, are constrained in scope, meaning that the structures that can be made are limited, and they are also difficult either to assemble or disassemble, sometimes both. In particular, sets for the construction of models sometimes do not offer the flexibility that enables the construction of an array of shapes and figures. That is, existing construction sets frequently lack the adaptability needed to construct diverse geometric figures. In addition, some sets suffer from structural weaknesses, causing rapid wear and reducing the lifespan of the components. Further, the assembly and disassembly processes might exert undue force on the components, leading to strains and handling difficulties. Since the purposes of many of these construction sets include inspiration and joy as well as learning, a construction set that is difficult and unpleasant to use is undesirable.

For the foregoing reasons, there is a need for in improved construction set configured to enable the construction of a wide array of structures, the construction set having parts that are easily assembled and disassembled.

SUMMARY

The present invention is directed to a rod and joint construction set configured for assembling diverse geometric figures like tetrahedrons, cubes and icosahedrons. The innovation focuses on providing a versatile, engaging, and educational construction system that encourages creativity, spatial understanding and structural exploration. The present rod and joint construction set aims to address the limitations described above in conventional construction systems. A benefit of embodiments of the construction set, that is, a set having connector sockets, double-ended rods with tapered pointed ends, and of the interaction between the sockets and inserted rods is that a large amount of variation in size and shape of both rods and sockets can be tolerated without affecting the correct operation of the construction system. Therefore, both the connectors and rods can be manufactured at a lower cost relative to conventional connector and rod construction systems that require accurate parts and high tolerance manufacture for correct operation.

Embodiments of the present construction system provide a solution that enables the assembly of various geometric figures with ease and structural integrity. The innovative design reduces force during assembly and disassembly, ensuring a longer lifespan for the components while promoting exploration and creative construction.

A first objective of embodiments of the present invention is to have a construction set that is material-efficient, inexpensive and easily mass-produced from a variety of materials using a variety of manufacturing techniques, e.g. 3-D printing, laser cutting, waterjet cutting, stamping, pressing, and molding. The materials are, for example, plastic, tin, copper, and other ductile materials.

Another objective of embodiments of the present invention is a construction set that is highly tolerant of manufacturing inaccuracies in both connector and rod components.

A further objective of embodiments of the present invention is a construction set that is flexible as to specific angular orientation. The benefit is that is allows for a large variety of known three dimensional geometries, shapes and two-dimensional tessellations, and for arbitrary sculptural forms and artistic creations.

A still further objective of embodiments of the present invention is a construction set that is easy and satisfying to assemble.

A still further objective of embodiments of the present invention is a construction set that is easy to disassemble and reuse.

A still further objective of embodiments of the present invention is a construction set that is applicable to structures at various scales from small models to large functional structures.

In a one embodiment, a socket in a connector for a construction system includes a receptacle having a top, a bottom and two sides defining a cavity. The cavity has a width and a height where the width is greater than the height. The cavity has a first opening. The first opening and the cavity are formed and configured to receive a rod at the first opening and into the cavity and is further formed and configured to engage with the rod in an interference fit at the top and the bottom of the cavity. This embodiment enables the pieces of the construction set to be assembled with joints that are secure but also enables the pieces to be disassembled easily.

In an alternative embodiment, the socket further includes a second opening on the cavity where the second opening is aligned with the first opening and the second opening is formed and configured to enable at least a portion of the rod to pass through the second opening.

In a further alternative embodiment, the socket includes a beam extending from the receptacle adjacent to the second opening. The beam connects the receptacle to the connector.

In a still further alternative embodiment, the socket has the cavity that is tapered, the cavity cross-sectional area decreasing from the first opening to the second opening. In another alternative embodiment of the socket, the first opening, the cavity, and the second opening are formed and configured to receive a tapered rod. In an alternative arrangement, the receptacle includes a narrow section included in the cavity at the second opening.

In another embodiment, the first opening and second opening of the socket are rectangular. In an alternative arrangement, the first opening and the second opening are oval in shape.

In another embodiment, the receptacle is made of a ductile material. In an alternative arrangement, the receptacle is made of an elastic material.

In another embodiment, a connector in a construction system includes a plurality of receptacles, connected around a central axial point. Each receptacle has a top, a bottom and two sides defining a cavity, the cavity having a width and a height where the width is greater than the height. The cavity has a first opening. The first opening and the cavity are formed and configured to receive a rod at the first opening and into the cavity and to engage with the rod in an interference fit at the top and the bottom of the cavity.

In an alternative embodiment of the connector, each receptacle further includes a second opening on the cavity, the second opening aligned with the first opening, the second opening formed and configured to enable at least a portion of the rod to pass through the second opening.

In a further alternative embodiment of the connector. the receptacles are symmetrically located around the central axial point.

In a still further alternative embodiment of the connector, the connector has at least three receptacles. In an alternative arrangement, the connector has six receptacles. In a still further alternative arrangement, the connector is made of a ductile material. In a still further alternative arrangement, the connector is made of an elastic material.

In another embodiment, a construction system has a plurality of rods and a plurality of connectors. Each connector has a plurality of receptacles, connected around a central axial point. Each receptacle has a cavity, a first opening on the cavity, and a second opening on the cavity. The second opening is aligned with the first opening. Each receptacle further has a beam extending from the receptacle adjacent to the second opening. The first opening, the cavity and the second opening are formed and configured to receive a rod from the plurality of rods at the first opening, for the rod to pass through the cavity and for at least a portion of the rod to pass through the second opening. The first opening and the cavity are further configured to engage with the rod in an interference fit.

In an alternative embodiment of the construction system, each connector in the plurality of connectors has three receptacles.

In a further alternative embodiment of the construction system, the plurality of connectors includes at least one connector having three receptacles where at least one connector has four receptacles, at least one connector has five receptacles, and at least one connector has six receptacles.

In a further alternative embodiment of the construction system, the rods in the plurality of rods have a first end and a second end and are tapered at the first end and the second end. In an alternative arrangement, the rods in the plurality of rods are of varying length.

The present invention together with the above and other advantages may best be understood from the following detailed description of the embodiments of the invention illustrated in the drawings, wherein:

DESCRIPTION

A construction system enables the construction of a variety of assemblages and structures. The construction system includes deformable N-way connectors (where N is typically a number between 2 and 6) and elongated rigid rods. The connectors in some embodiments each include at least one tapered socket configured to receive an end of a rod. The rods are generally cylindrical in shape and are tapered at either end. In some embodiments, the rods are pointed at the ends. The sockets and rods are configured such that each socket and the inserted rod have a limited surface area of engagement for easy assembly and disassembly. Additional aspects of the socket enabling ease of assembly, flexible construction and ease of disassembly will be described below.

Figure 1:
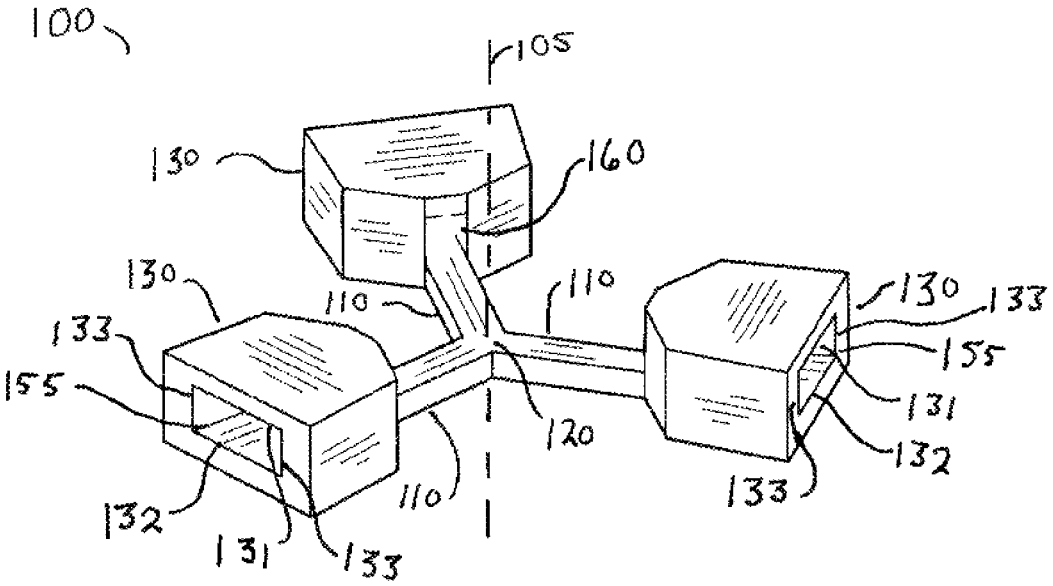
FIG. 1 is a perspective view of a connector having three sockets according to principles of the invention.
Figure 2:
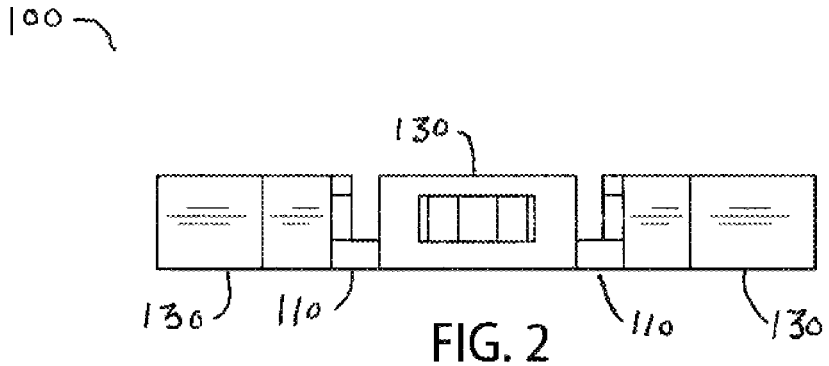
FIG. 2 is a front view of the connector of FIG. 1.
Figure 3:
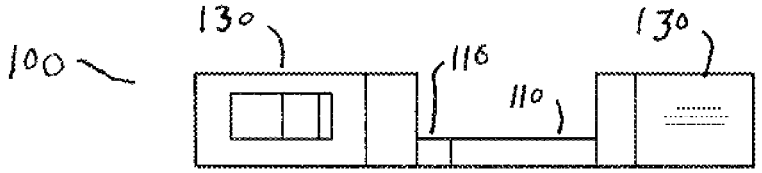
FIG. 3 is a left side view of the connector of FIG. 1.
Figure 4:
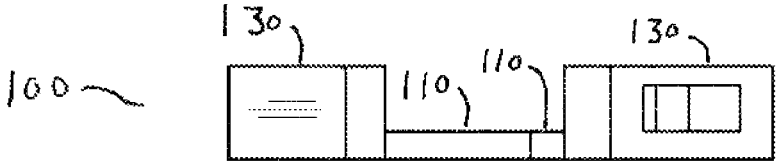
FIG. 4 is a right side view of the connector of FIG. 1.
Figure 5:
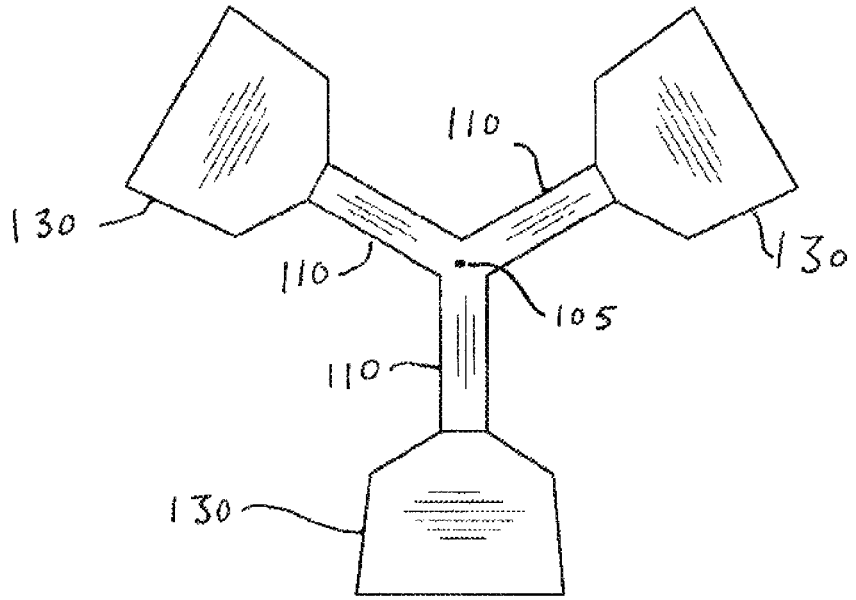
FIG. 5 is a top view of the connector of FIG. 1.
Figure 6:
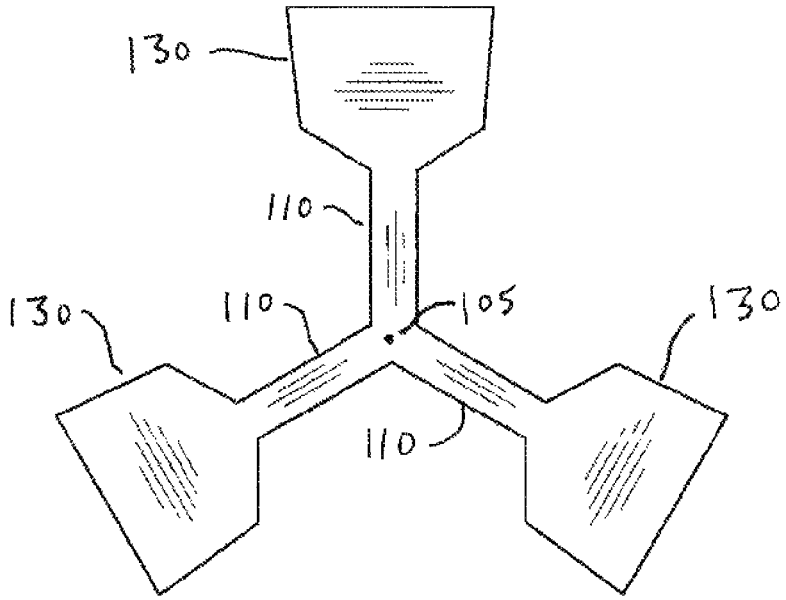
FIG. 6 is a bottom view of the connector of FIG. 1.

FIG. 1 is a perspective view of a connector 100 according to one embodiment. FIG. 2 is a front view of the connector of FIG. 1. FIG. 3 is a left side view of the connector of FIG. 1. FIG. 4 is a right side view of the connector of FIG. 1. FIG. 5 is a top view of the connector of FIG. 1. FIG. 6 is a bottom view of the connector of FIG. 1.

The connector 100 includes three beams 110 arranged around a central point, or central axis 105. The beams are also referred to as "arms." Each beam 110 has an axial end 120 and a distal end. The beams 110 are connected together at the axial ends 120. Each beam 110 has a socket 130 at the distal end. Each socket 130 has a first opening 155 and a second opening 160. In the present arrangement, the first opening 155 and second opening 160 are elongated and rectangular in shape. For the purpose of clarity of explanation, the long edges of the rectangle are also referred to as the top 131 and the bottom 132 and the short edges are also referred to as the sides 133. Each socket 130 is configured to receive and engage with a rigid rod in order to form a construction joint. The socket and the rod will be described in greater detail below.

Figure 7:
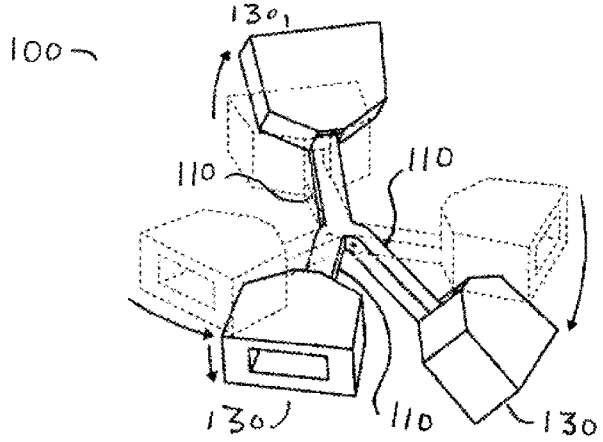
FIG. 7 is a perspective view of the connector of FIG. 1 in a first deformed state.
Figure 8:
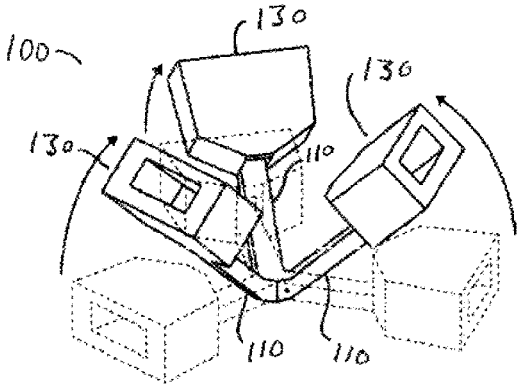
FIG. 8 is a perspective view of the connector of FIG. 1 in a second deformed state.

FIG. 7 shows the connector 100 in a first deformed state and FIG. 8 shows the connector in a second deformed state with the original undeformed states in dotted line. In some embodiments, the connector 100 is made from an elastic material and in other embodiments the connector is made from a ductile material. For example, the connectors may be made from plastic such as polypropylene, nylon or polyethylene or some copolymer. The connectors may also be made from metal such as copper, tin, aluminum, steel or some other alloy. The present invention should not be considered limited to the list of materials presented here. Process of manufacture for elements of the construction set include 3-D printing, molding, casting, pressing, cutting and bonding.

The beams 110 of the connector 100 may be flexed, or bent, to suit the structure being constructed.

Figure 9:
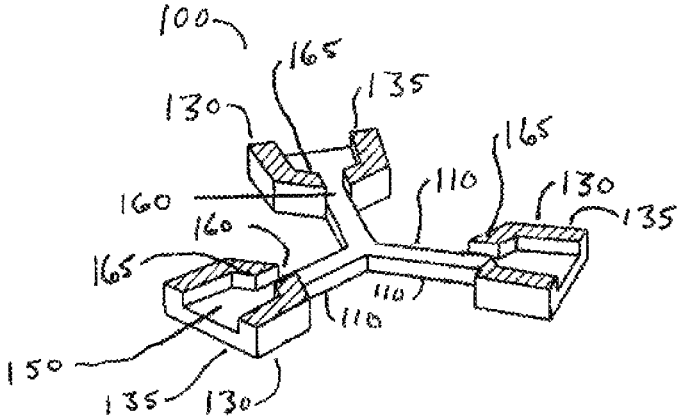
FIG. 9 is a perspective view of a horizontal cross-section of the connector of FIG. 1.
Figure 11:
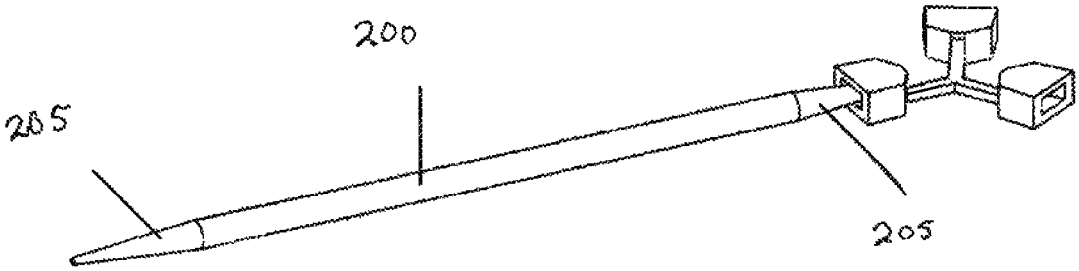
FIG. 11 is a perspective view of the connector of FIG. 1 further including a rod inserted into one of the sockets to form a joint.
Figure 10:
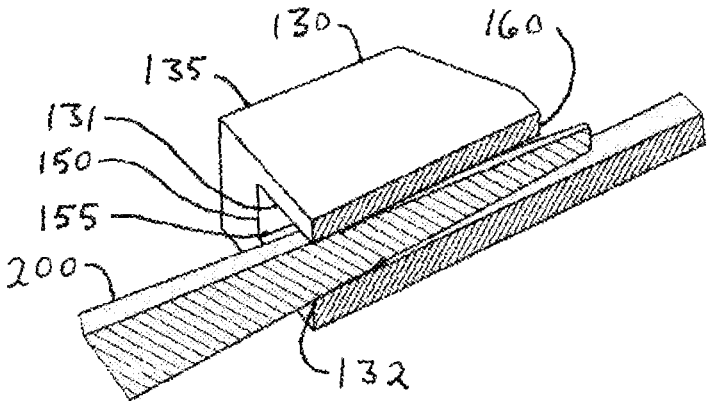
FIG. 10 is a vertical cross-section view of the connector of FIG. 1.

FIG. 9 is a perspective view of a horizontal cross-section of the connector of FIG. 1. FIG. 10 is a perspective view of a vertical cross-section of the connector of FIG. 1. FIG. 11 is a perspective view of the connector of FIG. 1 further including a rod 200 inserted into one of the sockets to form a construction joint. The details of the sockets 130 can be seen in the cross-sections in FIG. 9 and FIG. 10. Each socket 130 is a receptacle 135 having a cavity 150. Each socket 130 further has a first opening 155 and a second opening 160 onto the cavity 150. The first and second openings 155, 160 are elongated. In the present embodiment, the first opening 155 is larger in area than the second opening 160. In the present embodiment, the cavity 150 is tapered toward the second opening 160. The cavity 150 at the second opening 160 has a narrow section 165, the narrow section 165 having a width similar to the second opening 160. Each first opening 155 is aligned with its respective second opening 160 such that the socket 130 can receive a rigid rod 200 at the first opening 155, for the rod to enter the cavity 150 and then for a portion of the rod to pass through the second opening 160 and protrude as shown in FIG. 10. The socket cavity 150 is preferably tapered to guide the inserted rod 200 towards the center of the connector 100.

The rod 200 is substantially rigid and cylindrical in shape. The rod 200 is tapered at both ends 205. In some embodiments, the ends 205 of the rod 200 come to a point. The rod 200 is made from a material such as plastic, wood, metal, bamboo or some other rigid material.

Figure 12:
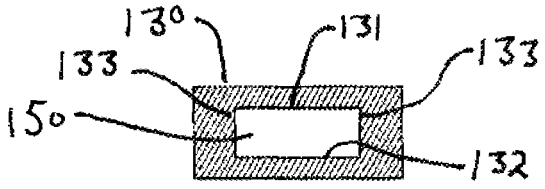
FIG. 12 is a cross-section view of a socket of the connector of FIG. 1.
Figure 13:
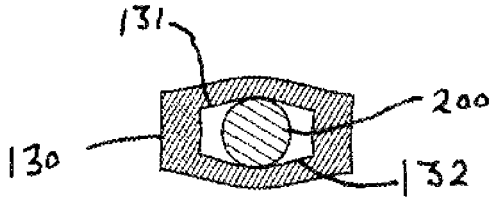
FIG. 13 is the cross-section view of FIG. 11 further including a cross-section of an inserted rod.

FIG. 12 shows a cross-section of the socket 130 close to the first opening 155 of the cavity 150. The socket 130 seen in FIG. 12 is undeformed. FIG. 13 shows a cross-section of the socket 130 at the first opening 155 of the cavity 150 and an inserted rod 200. The socket in FIG. 13 shows some deformation related to forming a joint with the rod 200 as described below.

The height (shorter dimension) of the first opening 155 is designed such that the dimension is less than the diameter of the rod cylinder away from the tapered ends 205. This ensures that the rod 200 after insertion into the first opening 155 and the cavity 150 engages with the top 131 and the bottom 132 of the cavity 150. Accordingly, this further ensures that the rod 200 does not freely move in and out of the socket cavity 150 axially or rotate within the socket cavity 150 and that the tapered end 205 of the rod 200 contacts the upper and lower inner surface of the socket cavity creating an interference fit having the desired manual insertion resistance and frictional grip between the rod 200 and connector 100.

As described above with regard to FIG. 9, FIG. 10 and FIG. 11, the socket cavity 150 is tapered toward the second opening 160 of the socket 130 to guide the rod 200 towards the center of the connector 100 as the rod 200 is inserted. The first opening 155 is formed and configured to receive the rod 200 into the cavity 150 and to engage with the rod 200 in an interference fit. The narrow portion 165 of the cavity 150 and the second opening 160 are formed and configured for a portion of the rod 200 to pass through and to protrude beyond the second opening 160. That is, a joint between the socket 130 and the rod 200 can be made by manually inserting a tapered end 205 of the rod 200 into the first opening 155 of the socket cavity 150 in a direction parallel to the axis of the beam 110 and toward the center of the connector 100. By pressing the rod 200 into the socket 130 in this way an interference fit is created. The socket 130 is configured to provide an interference fit between the top and bottom inner walls of the socket cavity 150 and the inserted rod 200 as shown in FIG. 10 and FIG. 13. This interference fit provides a secure connection between the rod 200 and connector beam 110 that enables the user to deform the connector beam 110 to a desired angular orientation by manipulating the distal end of the inserted rod. Once the desired orientation of the connector beam is achieved, the frictional grip provided by the interference fit maintains the desired orientation within, for example, a larger meshed structure.

In the present embodiment, the rod 200 is gripped by the upper and lower surface of the first opening 155 of the socket cavity 150 against the tapered portion of an end of the rod 200. This feature allows for variances in rod diameter, cross sectional shape, taper angle and length thereby reducing the cost of the rod components since tight manufacturing tolerances are not critical to the function of the rod and connector.

The joint between the socket 130 and rod 200 can be disassembled by manually pulling the rod 200 out of the socket 130 in the opposite direction to that used for insertion. Both the rod 200 and the connector 100 can be repeatedly reused.

In the present embodiment, the cross section of the socket cavity first openings 155 are approximately rectangular. In alternative embodiments, these openings 155 can by one of many other elongated shapes, for example, an ellipse, an oval, a trapezoid, or an elongated hexagon.

The socket configuration has the following benefits:

1. The socket facilitates manual insertion of a rod into the socket by creating a large target for the tapered end of the rod (similar to inserting a thread through the eye of a common needle).
2. The socket allows for angular variation between the rod central axis and the central axis of the socket thereby facilitating the creation of angled joint geometries.
3. The socket provides an intentionally progressive resistive force to the insertion of the rod so that it can be performed manually by the operator effectively. That is, the rods do not intentionally "snap" into place but can be inserted progressively until the desired location is attained.
4. The socket provides an intentionally progressive frictional gripping force between the connector and the rod through elastic deformation of the upper and/or lower socket walls as the rod is inserted and the tapered end is in contact with the upper and lower inner surfaces of the socket cavity.
5. The socket allows for variation in the length, diameter, cross-sectional shape, and taper angle of the rod components and still operate as intended as a joint.

Figure 14:
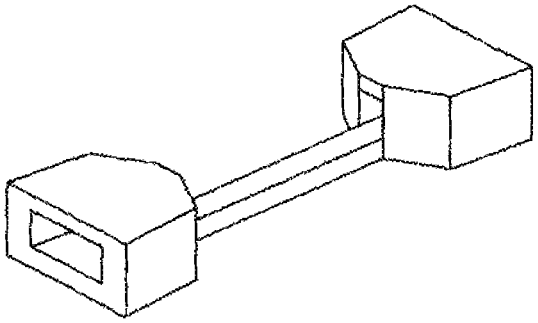
FIG. 14 is a perspective view of an alternative embodiment of the connector according to principles of the invention.

FIG. 14 is a perspective view of an alternative embodiment of the connector. The alternative embodiment is a connector 300 having two sockets 305 like the socket described above with regard to FIGS. 1-13 connected by a single beam.

Figure 15:
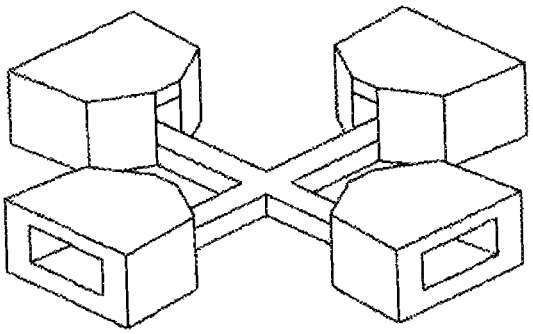
FIG. 15 is a perspective view of a second alternative embodiment of the connector according to principles of the invention.

FIG. 15 is a perspective view of a second alternative embodiment. The connector shown here has four sockets attached together by four centrally attached beams.

Figure 16:
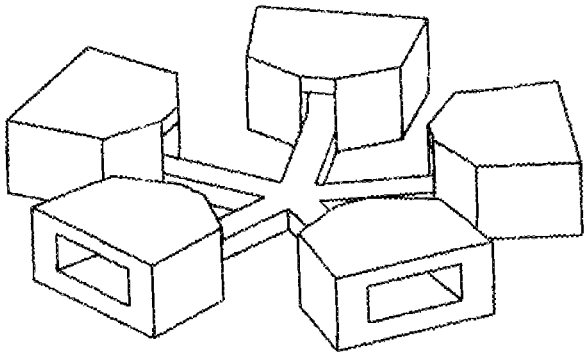
FIG. 16 is a perspective view of a third alternative embodiment of the connector according to principles of the invention.

FIG. 16 is a perspective view of a third alternative embodiment. The connector shown here has five sockets attached together by five centrally attached beams.

Figure 17:
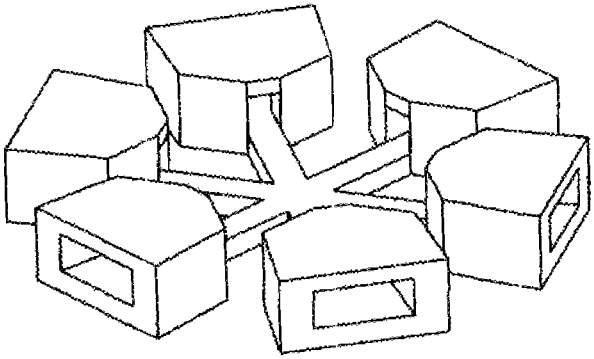
FIG. 17 is a perspective view of a fourth alternative embodiment of the connector according to principles of the invention.

FIG. 17 is a perspective view of a fourth alternative embodiment. The connector shown here has six sockets attached together by six centrally attached beams.

Figure 18:
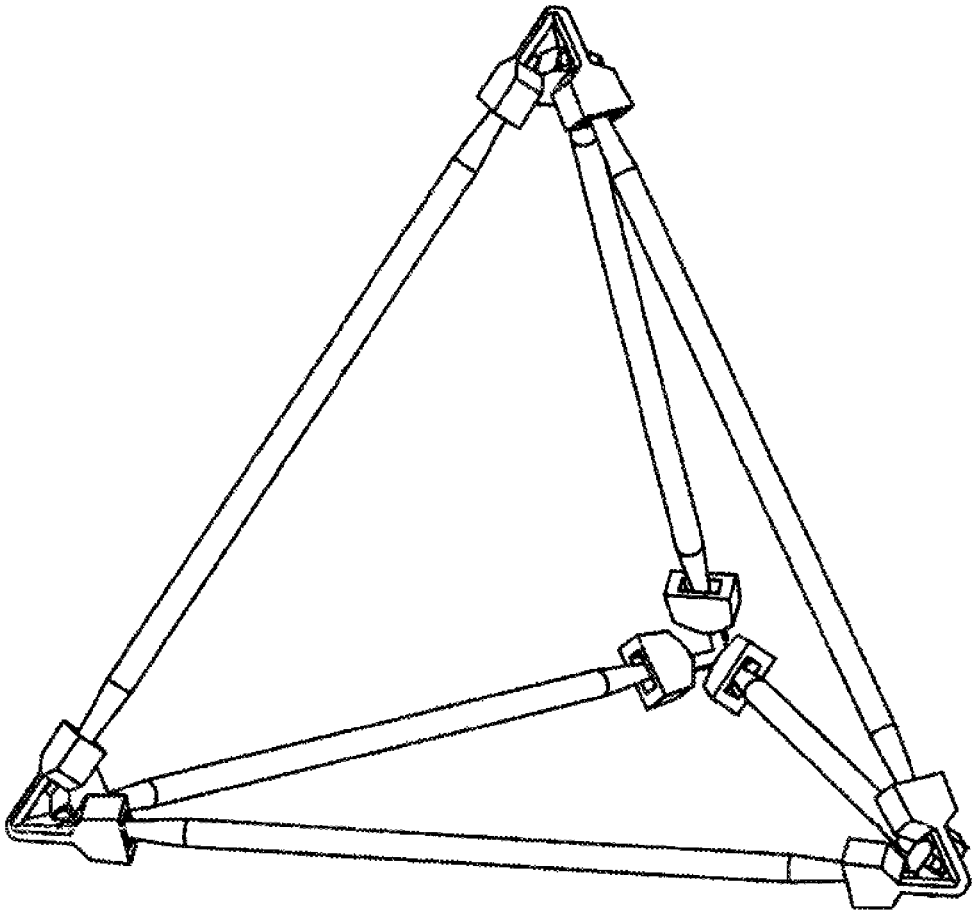
FIG. 18 is an example structure constructed from elements of the present construction set.

FIG. 18 is an example structure constructed with connectors and rods that are embodiments of the present invention.

The example structure is a model of a tetrahedron, the simplest Platonic solid, made from four (4) connectors according to the embodiment of FIG. 1 (also referred to as "three-way connectors") and six (6) rods. For each corner of the tetrahedron, deformation of the connectors around the central hub is shown. Additionally, for each corner the three rod axes can be seen to converge around a common point in space.

The connectors described herein can be oriented at arbitrary and unequal angles. For example, the beams of the three-way connector arms are, in some embodiments, equally spaced at 120 degrees relative to each other in the undeformed state but can be deformed to create unequal spacing as needed for the desired geometry. The arms can be deformed up and down relative to the plane of the undeformed connector. After inserting the rod into a socket, the rod can be held by the user and used as a lever to manipulate and deform (bend) the connector arm to the desired angular orientation.

Deformation of the connector arm generally occurs at the central hub of the connector—the convergence point of the arms (3). This leads to a joint geometry where all rod axes typically cross at a common point in space regardless of the angular orientation of each rod, thereby maintaining the geometric accuracy of the joint.

A construction system for building 2 or 3-dimensional permanent or temporary meshed assemblages and structures includes multiple deformable N-way connectors (where N is 2, 3, 4, 5, 6 or more) and multiple elongated rigid cylindrical rods with pointed tapers at each end. A collection of many embodiments of connectors and along with many rods (e.g. 10 s to 100 s of each) can be combined to form a construction kit for academic, engineering, educational, recreational and artistic purposes. As described above, the connectors include a plurality of beams, also referred to as "arms" typically in a planar, equally-spaced star-shaped configuration with each arm converging at a central point. At the distal end of each arm is attached a socket with an opening and a shaped cavity for accepting a rod. The rod in a preferred embodiment is tapered at each end.

Each arm of a connector can be manually deformed, that is, "bent", to create many variable joint geometries. A mesh structure can be constructed by joining rods to each of the sockets of an N-way connector, then joining further N-way connectors to the free unconnected ends of each of the rods, and repeating this until the desired mesh geometry is achieved. Once a rod is inserted in a socket the rod can be used as an extended lever to facilitate the bending and correct orientation of the connector arm connected to the socket. This is a useful method of constructing mesh structures.

The connector arms can be bent in the original undeformed plane to create, for example, planar star-shaped configurations with unequally spaced arms to create planar tessellated structures. The connector arms can also be bent perpendicular to the original undeformed plane to create 3-dimensional joints for creating 3-dimensional structures such as regular and irregular polyhedra, engineering structures, models of molecules such as Carbon nanostructures, and freeform artistic sculptures. In an alternative embodiment of the construction set, the rods can be of varying lengths thereby able to form more fanciful regular and irregular structures.

A benefit of the design of the connector sockets, the double-ended rods with tapered pointed ends, and of the interaction between the sockets and inserted rods is that a large amount of variation in size and shape of both rods and sockets can be tolerated without affecting the correct operation of the construction system. Therefore, both the connectors and rods can be manufactured at a lower cost relative to conventional connector and rod construction systems that require accurate parts and high tolerance manufacture for correct operation.

It is to be understood that the above-identified embodiments are simply illustrative of the principles of the invention. Various and other modifications and changes may be made by those skilled in the art which will embody the principles of the invention and fall within the spirit and scope thereof.

I claim:

1. A construction system, comprising:

a plurality of rods, each rod, in the plurality of rods, defining a first tapered section and a second tapered section opposite the first tapered section; and a plurality of connectors, each connector, in the plurality of connectors, comprising:

a plurality of receptacles connected around a central axial point, each receptacle, in the plurality of receptacles, comprising:

a cavity;

a first opening on the cavity;

a second opening on the cavity, the second opening aligned with the first opening and defining a rod axis extending through the second opening; and a body:

defining a central axial point;

comprising a set of beams arranged about the central axial point, each beam, in the set of beams:

extending from a receptacle, in the plurality of receptacles, through the second opening and to the central axial point;

defining an upper surface arranged below and facing the rod axis extending through the second opening;

configured to transiently mate with a tapered section of a rod in the plurality of rods:

extending through the first opening, the cavity, and the second opening along the rod axis and transiently seated against the upper surface of the beam, wherein the first opening, the cavity, the second opening, and the beam are configured to cooperate to:

transiently receive the tapered section of the rod at the first opening; and enable the tapered section of the rod to pass through the cavity and a portion of the rod to pass through the second opening to engage with the first opening, the cavity, and the upper surface of the beam in an interference fit.

2. The construction system of claim 1, wherein the first opening is rectangular.

3. The construction system of claim 1, wherein the first opening is oval.

4. The construction system of claim 1, wherein each connector, in the plurality of connectors, comprises three receptacles.

5. The construction system of claim 1, wherein the plurality of connectors comprises:

a first connector comprising three receptacles;

a second connector comprising four receptacles;

a third connector comprising five receptacles; and a fourth connector comprising six receptacles.

6. The construction system of claim 1, wherein rods, in the plurality of rods, are of varying length.

7. The construction system of claim 1, wherein each beam, in the set of beams, is configured to flexibly rotate about the central axial point to a target orientation.

8. The construction system of claim 1:
wherein the first opening defines a first cross section; and
wherein the second opening defines a second cross section smaller than the first cross section.

9. The construction system of claim 1, wherein the set of beams is arranged symmetrically about the central axis point.

10. The construction system of claim 1:
wherein the first opening of each receptacle, in the plurality of receptacles, defines a first cross section;
wherein the second opening of each receptacle in the plurality of receptacles:
defines a second cross section smaller than the first cross section; and
defines the rod axis extending through a center of the second cross-section;
wherein the upper surface of each beam, in the set of beams, is arranged below and facing the rod axis.

11. The construction system of claim 1, wherein each connector, in the plurality of connectors, comprises:
a plurality of three receptacles; and
the body comprising a set of three beams connecting to the plurality of three receptacles to the central axial point.

12. A connector in a construction system, comprising:
a plurality of receptacles connected around a central axial point, each receptacle, in the plurality of receptacles, comprising:
a top, a bottom, and two sides defining a cavity exhibiting a height and a width greater than the height; and
a first opening on the cavity, the first opening and the cavity formed and configured to:
receive a tapered rod at the first opening and into the cavity; and
engage with the tapered rod in an interference fit at the top and the bottom of the cavity; and
a second opening on the cavity aligned to the first opening and defining a rod axis extending through the second opening; and
a body:
defining the central axial point; and
comprising a plurality of beams flexibly arranged about the central axial point and connecting the plurality of receptacles to the central axial point, each beam, in the plurality of beams:
configured to flexibly rotate about the central axial point to seat in a target orientation;
extending from the central axial point through the second opening of a receptacle in the plurality of receptacles; and
forming the bottom of the cavity arranged below the rod axis and configured to transiently engage with the tapered rod seated along the rod axis in the interference fit.

13. The connector of claim 12, wherein the plurality of receptacles are symmetrically located around the central axial point.

14. The connector of claim 12, wherein the plurality of receptacles comprises at least 3 receptacles.

15. The connector of claim 12, wherein the plurality of receptacles comprises six receptacles.

16. The connector of claim 12, wherein the body is formed of an elastic material.

17. The connector of claim 12:
wherein the plurality of beams is arranged in a first angular orientation relative the central axial point at a first time; and
wherein the plurality of beams is arranged in a second angular orientation relative the central axial point at a second time, the second angular orientation different from the first angular orientation.

18. A construction system comprising:
a first connector, in a set of connectors, comprising:
a set of receptacles arranged around a central axial point, each receptacle, in the set of receptacles, comprising:
a cavity;
a first opening on the cavity; and
a second opening on the cavity, the second opening aligned with the first opening and defining a rod axis extending through a center of the second opening; and
a body:
defining the central axial point;
comprising a set of beams arranged about the central axial point, each beam, in the set of beams:
extending from a receptacle, in the set of receptacles, through the second opening and to the central axial point;
defining an upper surface arranged below and facing the rod axis extending through the second opening;
a first rod, in a set of rods, defining a first tapered section configured to transiently insert into a first receptacle, in the set of receptacles, to seat along a first rod axis of the first receptacle and engage with surfaces of the first receptacle and a first upper surface of a first beam, in the set of beams, in a first interference fit; and
a second rod, in the set of rods, defining a second tapered section configured to transiently insert into a second receptacle, in the set of receptacles, to seat along a second rod axis of the second receptacle and engage with surface of the second receptacle and a second upper surface of a second beam, in the set of beams, in a second interference fit.

19. The construction system of claim 18, wherein each beam, in the set of beams, is configured to flexibly rotate about the center point to a target orientation.

20. The construction system of claim 18, further comprising:
a second connector, in the set of connectors, comprising:
a second set of receptacles arranged about a second central axial point, each receptacle, in the second set of receptacles, comprising:
a second cavity;
a third opening on the second cavity; and
a fourth opening on the second cavity aligned with the third opening and defining a second rod axis extending through a center of the fourth opening; and
a second body:
defining the second central axial point;
comprising a second set of beams arranged about the second central axial point, each beam, in the second set of beams:
extending from a receptacle, in the second set of receptacles, through the fourth opening and to the second central axial point; and
defining a second upper surface arranged below and facing the second rod axis extending through the fourth opening; and wherein the first rod defines a third tapered section, opposite the first tapered section, configured to transiently insert into a third receptacle, in the second set of receptacles, to seat along a third rod axis of the third receptacle and engage with surfaces of the third receptacle and a third upper surface of a third beam, in the second set of beams, in a third interference fit; and wherein the second rod defines a fourth tapered section configured to transiently insert into a fourth receptacle, in the second set of receptacles, to seat along a fourth rod axis of the fourth receptacle and engage with surfaces of the fourth receptacle and a fourth upper surface of a fourth beam, in the second set of beams, in a fourth interference fit.

* * * * *